US005603438A

United States Patent [19]

Jugan

[11] Patent Number: 5,603,438

[45] Date of Patent: Feb. 18, 1997

[54] GARMENT HANGER

[76] Inventor: Bruce M. Jugan, 699 S. Grand Ave., Pasadena, Calif. 91105

[21] Appl. No.: 647,693

[22] Filed: May 13, 1996

Related U.S. Application Data

[63] Continuation-in-part of Ser. No. 319,556, Oct. 6, 1994, abandoned.

[51] Int. Cl.[6] ..... A47G 25/40; A47G 25/44; A47G 25/18

[52] U.S. Cl. ..... 223/89; 223/88; 223/94; 223/85

[58] Field of Search ..... 223/88, 85, 89, 223/92, 94, 77, 95, 74; 211/113; D6/315, 324

[56] References Cited

U.S. PATENT DOCUMENTS

| | | | |
|---|---|---|---|
| 1,070,236 | 8/1913 | Doose | 223/95 |
| 2,418,083 | 3/1947 | Mayer | 223/74 |
| 2,553,116 | 5/1951 | Simons | 223/95 |
| 2,814,426 | 11/1957 | Miller | 223/94 |
| 4,593,839 | 6/1986 | Vandoros | 223/63 |
| 4,830,237 | 5/1989 | Louw | 223/89 |
| 5,052,599 | 10/1991 | Platti | 223/89 |
| 5,082,152 | 1/1992 | Chen | 223/89 |
| 5,303,855 | 4/1994 | Veale | 223/85 |

*Primary Examiner*—Bibhu Mohanty
*Attorney, Agent, or Firm*—Michael J. Brown

[57] ABSTRACT

An improved garment hanger for adjustably displaying, transporting and storing multiple articles of clothing. The hanger supports an upper garment and a lower garment. The lower garment is supported and located away from a plane formed by the supported upper garment, both horizontally and vertically. The position of the lower garments relative to the upper garments may be adjusted through the use of telescoping members. The degree of extension of the telescoping members is controlled by restraining the telescoping members in a variety of positions.

13 Claims, 6 Drawing Sheets

GARMENT HANGER

This is a continuation-in-part of U.S. application Ser. No. 08/319,556, filed Oct. 6, 1994 now abandoned.

BACKGROUND OF INVENTION

1. Technical Field

The present invention is directed to garment hangers for storing, transporting and displaying articles of clothing. The present invention is specifically directed to garment hangers for multiple garments.

2. Background Information

Garment hangers commonly comprise two connected shoulder bars with a hanging hook located between the shoulder bars, where the shoulder bars extend outward and down from the hook and simulate the shape or breadth of human shoulders. This style of hanger is used for coats, jackets, shirts and similar articles of clothing worn on the upper torso. A well known variation comprises the two shoulder bars and a cross bar connecting the outwardly extending ends of the shoulder bars, forming a triangle. The connecting cross bar may be of the same or different material as the shoulder bars, and serves the additional purpose of hanging different articles of clothing. In this fashion, the triangular hanger is more versatile than the two shoulder bar hanger. The triangular frame is often used for displaying, transporting and storing a wide variety of clothing, including those previously mentioned, as well as pants, skirts, other lower torso garments, and accessories such as ties, scarves and belts.

In order to maintain the appearance of the garment, garment hangers usually present the supported garment in a plane, where the folds and creases of the garment are preserved. This is achieved by a plane formed by the hanger itself. For storage purposes, the plane of existing garment hangers is usually as flat as possible to allow the hung garments to occupy as little space as possible.

Most garment hangers have an attached hook or other retaining means as is well known in the art for removably mounting the hanger on a rod or other support means. This retaining means is centrally located on the hanger and is attached either at the apex of the triangular shaped frame or between the two shoulder bars. The retaining means is normally located at a central point to allow the hanger to be balanced when laden and unladen. The plane formed by the hanger is usually perpendicular to the rod or other support means, however it is known in the art to allow the retaining means to rotate relative to the plane formed by the hanger.

Alternative and more specialized display, transportation and storage devices exist for specific types of clothing and for use in the fashion industry. Among these specialized devices are fixed display stands which are used instead of mannequins to show the approximate appearance of clothing on a person and hangers for fashion accessories such as belts and scarves.

Most prior art garment hangers which provide for displaying, transporting and storing multiple articles of clothing provide a fixed relationship in the location of upper and lower garment support means, placing the lower garment support means directly beneath, and within the same plane as, the upper garment support means when the hanger is supported by the retaining means. In this relationship, the upper garment covers the lower garment. This presents a problem and an inconvenience in the removal of the lower garment which is covered in full or in part by the upper garment.

When using the triangular hanger for clothing combinations such as a man's or woman's suit, comprising an upper garment, such as a jacket, and a lower garment, such as pants or a skirt, it is often desired to remove the lower garment from the hanger before removing and without disturbing the upper garment. With conventional hangers, removing the lower garment without disturbing the upper garment is not easily achieved and may be impossible. Dislodging the upper garment may cause the upper garment to fall on the floor or cause the upper garment to become wrinkled or disarrayed. Mishandling or dropping of the upper garment, while attempting to remove the lower garment, can damage or wrinkle delicate fabrics. Therefore, it is desired to have an improved hanger that will allow easier removal of the lower garment before removing and without disturbing the upper garment.

When a complete suit or other clothing combination is displayed on a conventional hanger, the upper garment is in full view of the intended audience, while the lower garment is substantially or entirely hidden by the upper garment. Quite Often the lower garment is of a different pattern or material from the upper garment and this difference may be a significant factor in a prospective purchaser's decision to buy the clothing. It is therefore desired to have an improved hanger that will allow the simultaneously display of both the upper and lower garments.

Generally in the past, garment hangers have been constructed with nonadjustable garment support members, also known as drops. The existing drops, which have been used for specific purposes, are too short to adequately address the problem of viewing or removing the lower garment without disturbing the upper garment. A hanger that is sufficiently elongated to separate the garment support members such that the lower garment may be viewed or removed easily is desired.

Conventional garment hangers are designed to minimize the space occupied in a closet, thereby designed to occupy a narrow plane, which is often perpendicular to the rod or other support means. In accord with this purpose, existing drops locate the lower garment directly below the upper garment.

Existing hangers and garment display devices create and otherwise do not address the problems described. Prior art hangers that incorporate extensions, such as Chen U.S. Pat. No. 5,082,152 and Bell U.S. Pat. No. 2,574,999, are directed toward adjusting the width of the hanger, specifically in varying the width of the shoulder portion of the garment hanger, by extending the length of the shoulder portion segments. These hangers however only maintain the shape of upper torso garments such as jackets and shirts which vary in breadth. No provision is made, nor is there a need, for adjustment relative to the length of the upper torso garment. Prior art hangers, such as Doose U.S. Pat. No. 1,070,236, while showing extendible hangers, do not show extensions outside of the plane of the upper garment support means nor do they provide fixed size support for lower torso garments.

It is an object of the present invention to provide a garment hanger adapted to hold multiple articles of clothing in an adjustable relationship.

It is an additional object of the present invention to provide an improved hanger which will suspend articles of clothing with sufficient horizontal and vertical separation for convenient display and access. The horizontal separation distance need only be sufficient to separate the upper and lower garments, placing the lower garment in front or in back of the plane of the upper garment. A desired vertical separation distance between the upper and lower garments may be determined from the height of the upper garment, where the lower garment is desired to hang at or below the level of the bottom edge of the upper garment.

It is still another object of the present invention to provide an improved hanger that will readily allow removal of pants, skirts or similar articles from the hanger prior to the removal of coats, jackets and the like from the hanger.

It is yet another object of the present invention to provide an improved hanger that will allow for the improved display of multiple articles of clothing, revealing articles that are concealed using existing and previously known hangers.

These and other objects, features and advantages of the present invention will become more evident from the following discussion and drawings in which:

SUMMARY OF INVENTION

Figure 1:
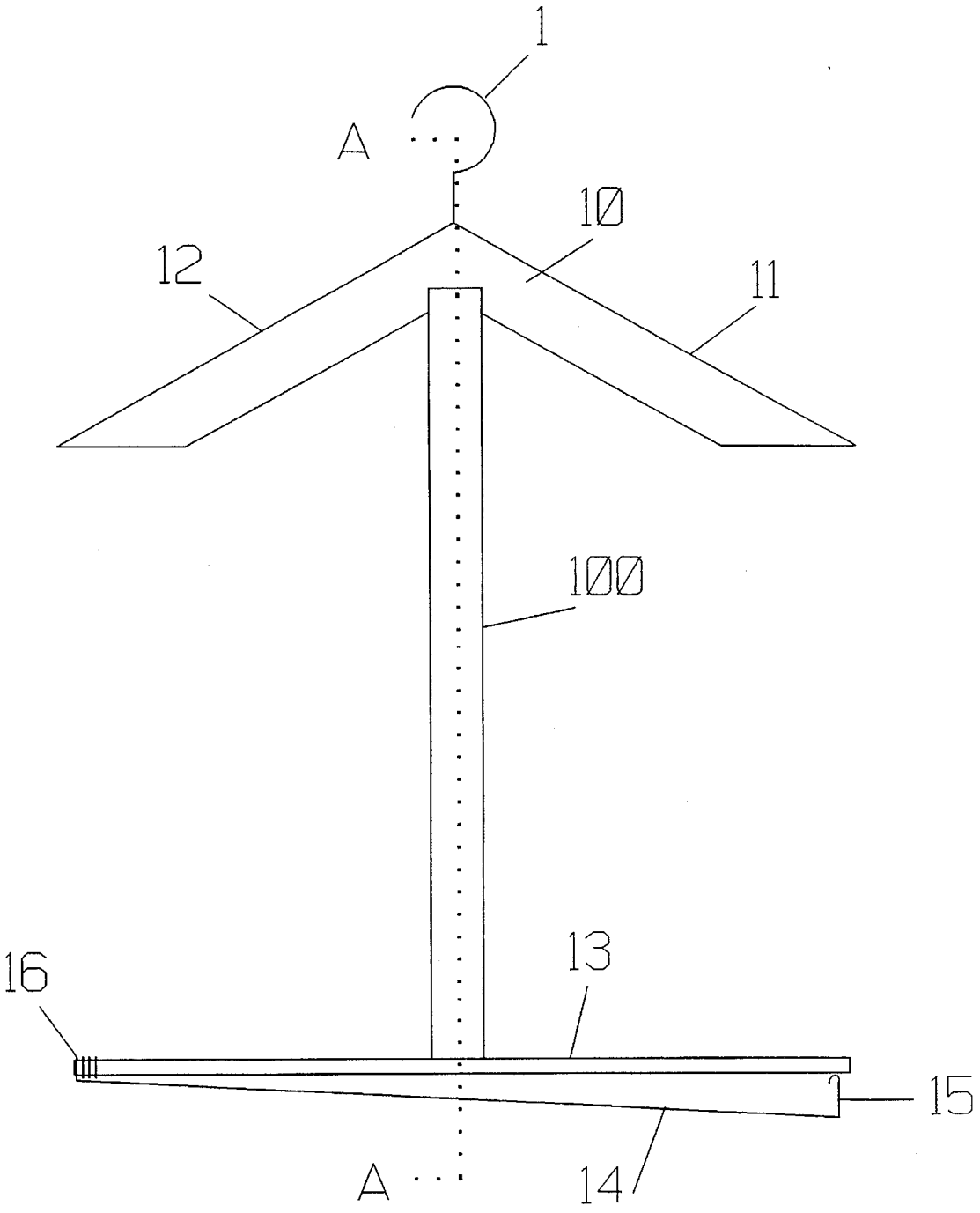
FIG. 1 is an external view of the present invention showing extension means extending outward from the plane of the upper garment support means.

Generally, the present invention comprises an improved garment hanger, adapted to be suspended on a supporting member by retaining means. The garment hanger comprises first garment support means depending from retaining means, fixed length second garment support means and extension means, depending below and from the first garment support means, which extension means connects the first and second garment support means. The first garment support means forms a plane. The position of the second garment support means relative to the first garment support means is determined by the extension means.

The extension means may comprise a projection extending downward at an angle to the plane formed by the first garment support means.

The extension means may also comprise telescoping means comprised of a fixed member attached to the first garment support means and an extendible member movably connected to the fixed member. The extendible member supports the second garment support means.

The telescoping means thus allows the user thereof to adjustably control the distance between the support means on the hanger for upper and lower garments. This permits control of the presentation of the suspended apparel and also allows for convenient storage and transportation of the hanger, both laden and unladen. The telescoping means allows for a variation in the height of the upper garments, and therefore allows for adjustment of the position of the lower garments relative to the upper garments. Thus, the hanger of the present invention used to display a suit to be worn by a 7 foot tall basketball player may also be used to display a suit to be worn by a 5 foot tall jockey. The telescoping feature of the invention also allows the user to reduce the size of the hanger for convenient transportation and storage.

DETAILED DESCRIPTION

The present invention comprises an improved hanger for displaying, transporting and storing multiple articles of clothing, where the improved hanger provides for adjusting and extending the horizontal and vertical separation distance between an upper garment and a lower garment. The invention comprises upper and lower garment support members, which are of a design well known in the art. The upper garment support member is suspended on a rod or other external support from a hook or other retaining means as is well known to the art. The upper garment support member ideally supports one article of clothing worn on the upper torso, but may support lower torso garments or more than one article of clothing. The lower garment support member ideally supports one article of clothing worn on the lower torso, but may support upper torso garments or more than one article of clothing.

Dependent from the upper garment support member, and in turn supporting the lower garment support member, are extension means for presenting the lower garment. In a preferred embodiment, the extension means projects outward from a plane created by the upper garment support member, which plane may be perpendicular to the rod or other external support when the hanger is in use. The projecting extension means may be of any shape or cross-section, may be hollow or filled, and may be made of any material.

In another embodiment, the extension means are comprised of slidably connected telescoping members, preferably an upper and a lower tube. The upper tube is preferably hollow. The lower tube has an external diameter less than the internal diameter of the hollow upper tube, allowing the lower tube to be inserted into and move freely within the upper tube.

The cross-sections of the upper and lower tubes are preferably identical in shape. To prevent or limit undesired swivelling motion of the lower garment support member, the cross-sections of the upper and lower tubes may be of any angled shape.

The lower garment support member depends from the bottom end of the lower tube. Means for controlling the degree of extension of the telescoping means are provided to allow for adjusting the position of the lower garment support member relative to the upper garment support member.

DESCRIPTION OF THE PREFERRED EMBODIMENTS

Figure 1A:
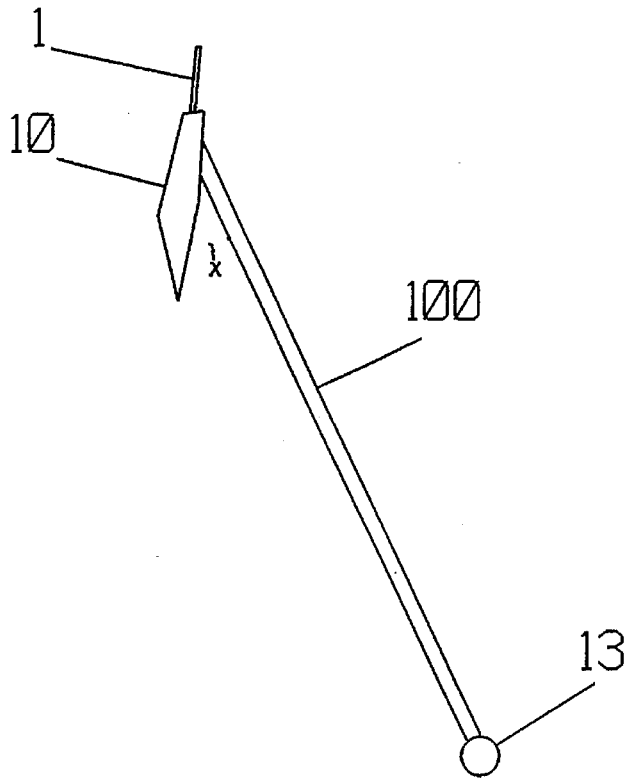
FIG. 1A is an side view of the present invention as seen along line A—A of FIG. 1.

In a preferred embodiment, as shown in FIGS. 1 and 1*a*, two bilaterally connected shoulder bars 11 and 12 are rotatably suspended from a centrally located hook 1. The hook is used to support the hanger on a clothes rod or other device as is well known in the art. The shoulder bars form the upper garment support means 10 and may be curved to simulate the shape of human shoulders.

An upper end of extension means led is attached at an angle x to the upper garment support means 10 directly below the centrally located hook 1. Angle x may be any acute angle. The length of extension means 100 may vary depending on the user's preference, the degree of angle x and the range of desired separation distances. The lower end of extension means 100 is attached to the longitudinal center of the lower garment support bar 13 to provide a balanced support for the lower garment support bar.

Lower garment support bar 13 is attached at the downward extending end of extension means 100. As is known in the art, a restraining wire 14 is attached by a coil 16 at one end of the lower garment support bar 13 and is removably attached at the other end by a hook 15 to retain the pants or other garments along the lower garment support bar 13. Alternatively, clips or other means may be provided along the lower garment support bar for attaching a skirt or any other garment to the lower garment support bar, such as pants supported at the waistband or cuffs.

Figure 2:
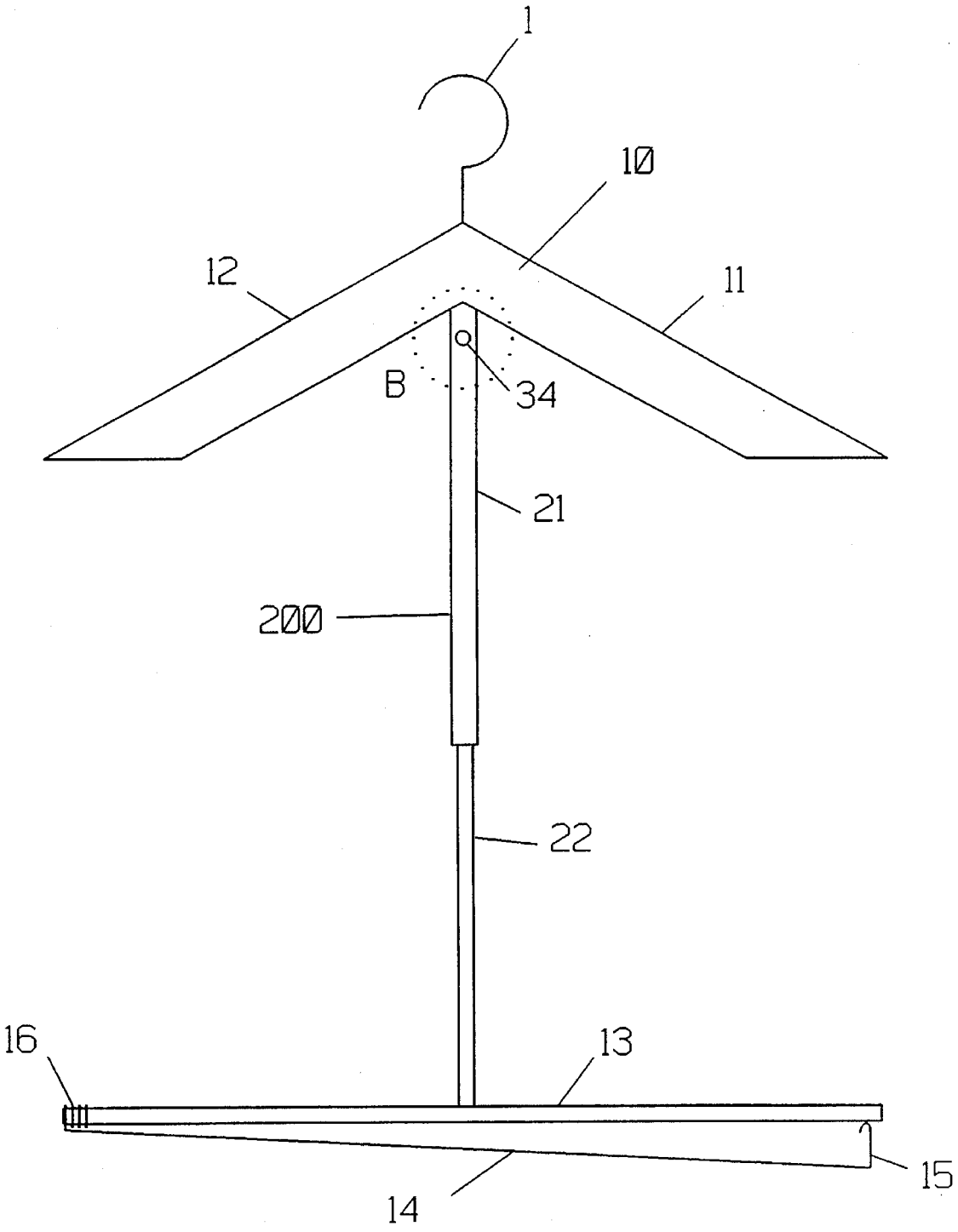
FIG. 2 is an external view of the present invention showing telescoping means.

In another embodiment, as shown in FIG. 2, a hollow tube 21, the upper portion of the telescoping means 200, is attached to the upper garment support means 10 directly below the centrally located hook 1. The length of the upper tube 21 may vary depending on the user's preference and the range of desired separation distances.

A lower tube 22, the extendible portion of the telescoping means 200, is removably inserted into the upper tube 21 and extends downwardly therefrom. The lower tube 22 is attached to the longitudinal center of the lower garment support bar 13 to provide a balanced support for the lower garment support bar.

The external diameter of the lower tube 22 is narrower than the internal diameter of the upper tube 21 to permit free movement of the lower (inner) tube 22 within and relative to the upper (outer) tube 21. The length of the lower tube may also vary according to the preference of the user and the desired separation distance.

Figure 3:
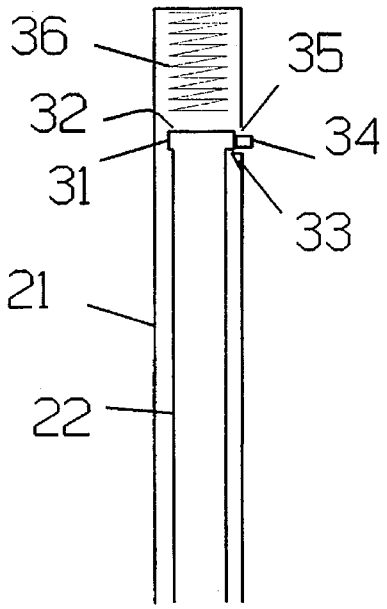
FIG. 3 is a side cross-sectional view of circled area B of FIG. 2, showing the preferred means for controlling the telescoping feature of the present invention.

The preferred means for controlling the telescoping feature of the present invention is shown in FIG. 3. A lip or edge 31 is formed at the upper end 32 of the lower tube 22. Within the upper tube 21, a mechanism 33 is provided to engage the formed lip 31 of the lower tube. This engaging mechanism 33 is located such that the formed lip of the lower tube engages the mechanism when the lower tube is fully retracted into the upper tube. Button means 34 for releasing the engaging mechanism are provided near the top of the upper tube, extending through a hole 35 in the upper tube.

Resilient means 36 are provided within the upper tube 21, biasing the lower tube 22 in a downward direction. When the button means 34 releases the lower tube lip 31 from the engaging mechanism 33, the resilient means 36 directs the lower tube downward, extending the telescoping means 200 and thereby lowering the lower garment support bar 13 relative to the upper garment support means 10.

Figure 4:
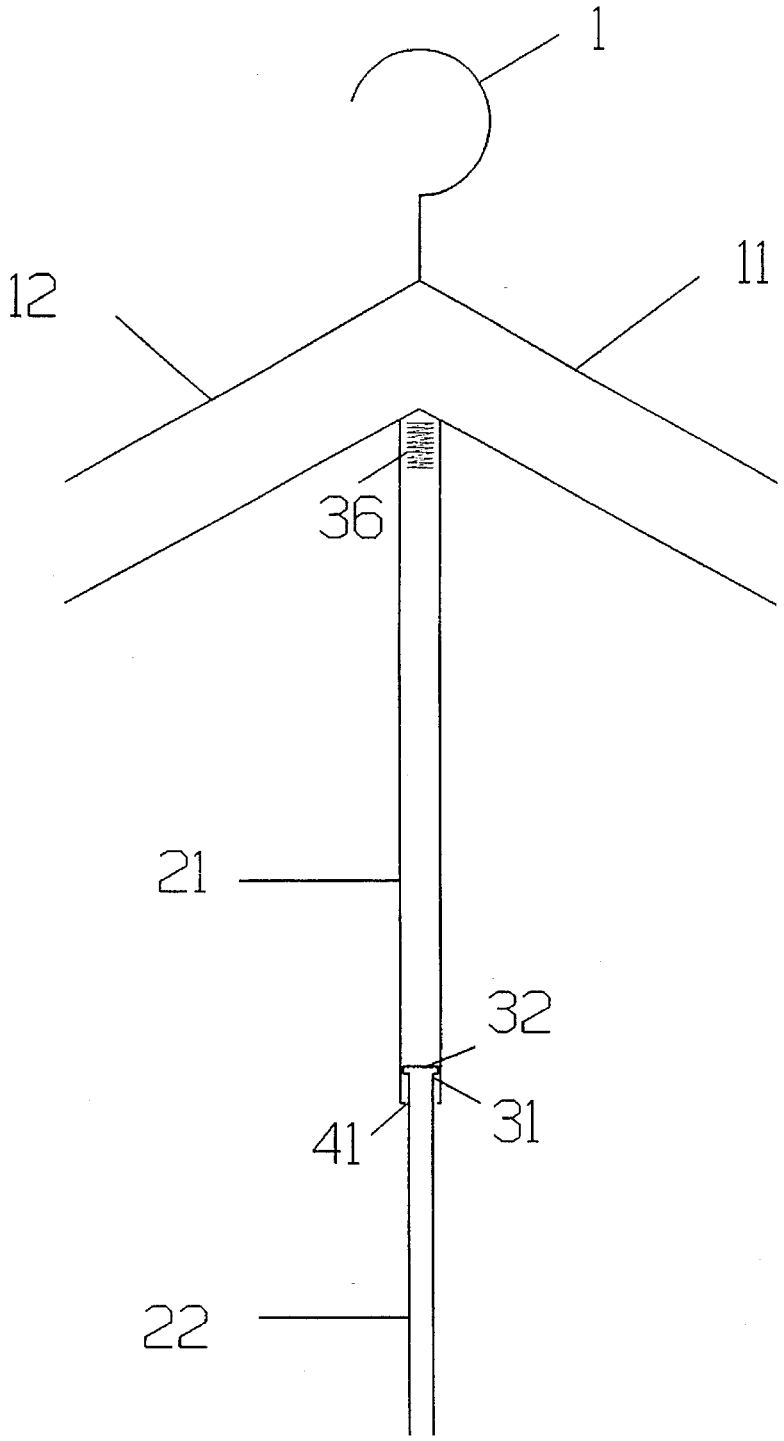
FIG. 4 is a cross-sectional view showing the preferred embodiment of the telescoping means of the present invention.

As shown in FIG. 4, the lower end 41 of upper tube 21 may be constricted such that the diameter of the lower end 41 is narrower than the diameter of the lip 31 at upper end 32 of lower tube 22. This prevents the lower tube 22 from extending past upper tube 21, thereby limiting the extension of the telescoping means 200.

In an alternative embodiment, the telescoping means 200 may comprise more than two slidably connected members. The number of such members and their lengths will determine the height of the hanger in both extended and retracted positions as well as the separation distance achieved by the hanger in such extended and retracted positions.

Figure 5A:
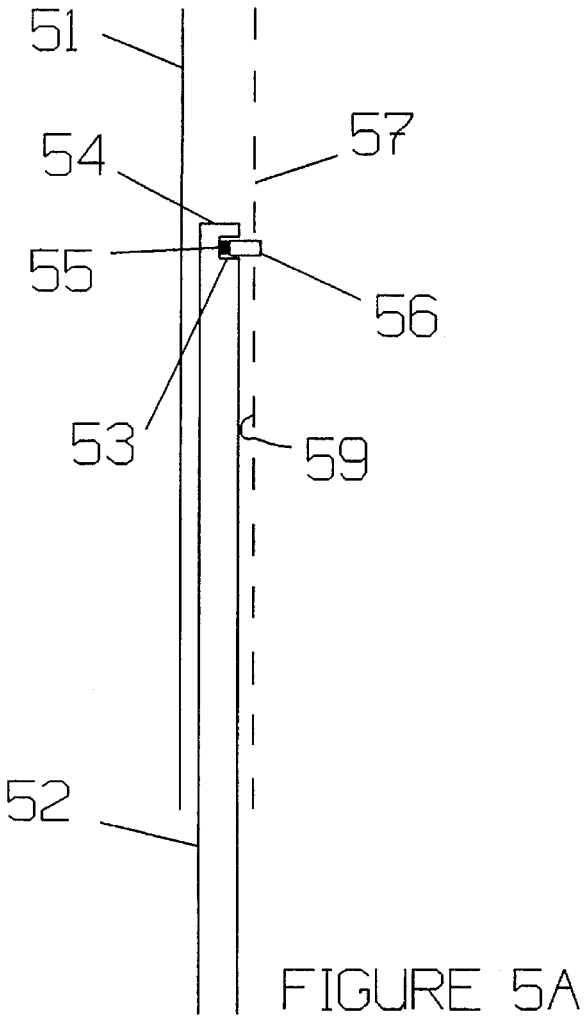
FIG. 5*a* is a side cross-sectional view of an alternate embodiment of the means for controlling the extension of the telescoping means of the present invention.

In FIG. 5*a* is shown an alternative embodiment of the means for controlling the extension of the telescoping means. A cavity 53 is located at the upper end 54 of the lower tube 52. A spring or other resilient means 55 is placed within the cavity 53. A peg 56 is placed within the cavity 53, protruding outward and biased outward by the resilient means 55. External pressure upon the peg 56, directed inwardly, forces the peg to withdraw within the cavity 53 of the lower tube 52. Upon the release of the external pressure, the resilient means 55 will direct the peg 56 outward.

Figure 5B:
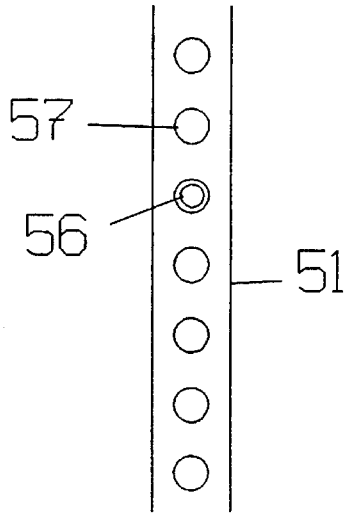
FIG. 5*b* is an external view of part of the alternate embodiment shown in FIG. 5*a*.

As shown in greater detail in FIG. 5*b*, notches 57 are provided in the side of the upper tube 51, running up the long axis of the upper tube. The diameter of the notches is greater than the diameter of the lower tube peg 56. When the peg is extended outward from the lower tube, it engages at least one of the notches 57 provided along the upper tube, thereby preventing the lower tube 52 from moving relative to the upper tube. It is desired that the exterior end of the peg 56 protrude out through a notch 57 in the outer tube. Withdrawal of the peg 56 places the exterior end of the peg level within the inner surface 59 of the upper tube 51.

Figure 6:
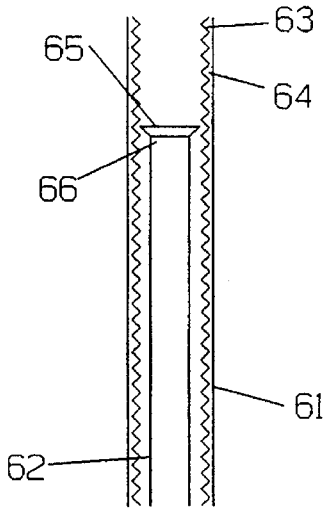
FIG. 6 is a cross-sectional view of an alternate embodiment of the means for controlling the extension of the telescoping means of the present invention.

FIG. 6 shows an alternative embodiment of the means for controlling the extension of the telescoping means, where such controlling means may be comprised of screw threading 63 on the interior surface 64 of the upper tube 61 and screw engaging means 65 on the exterior of the lower tube 62, preferably at the upper end 66 of the lower tube 62. The position of the lower tube 62 is adjusted by turning the lower tube until it is in the desired position. For such an alternative embodiment, the cross-section of the interior surface 64 of the upper tube and the screw engaging means 65 on lower tube should be circular. This alternative embodiment will work with an embodiment that comprises a plurality of telescoping means where the lower tubes of the telescoping means are not permanently attached to the lower garment support bar. The lower tubes would be positioned first and then the lower garment support bar would be attached to the lower tubes.

An alternative embodiment of the controlling means may be comprised of material placed within the upper tube which restrict or limit the movement of the lower tube relative to the upper tube. Examples of such materials are cloth felt or rough surfaced metal or wood. Magnetic material may also be placed within the upper tube and on the lower tube to maintain the position of the lower tube relative to the upper tube.

Yet another alternative embodiment of the controlling means may be comprised of an external clamp surrounding the lower end of the upper tube as is well known in the art. When the lower tube is in a desired position, the external clamp may be tightened, increasing the friction between the upper and lower tubes, thereby restricting movement of the lower tube relative to the upper tube.

A further alternative embodiment of the controlling means may be comprised of constrictions in the upper tube which restrict or limit the movement of the lower tube relative to the upper tube. Means may be added to the lower tube to engage such constrictions.

Figure 7:
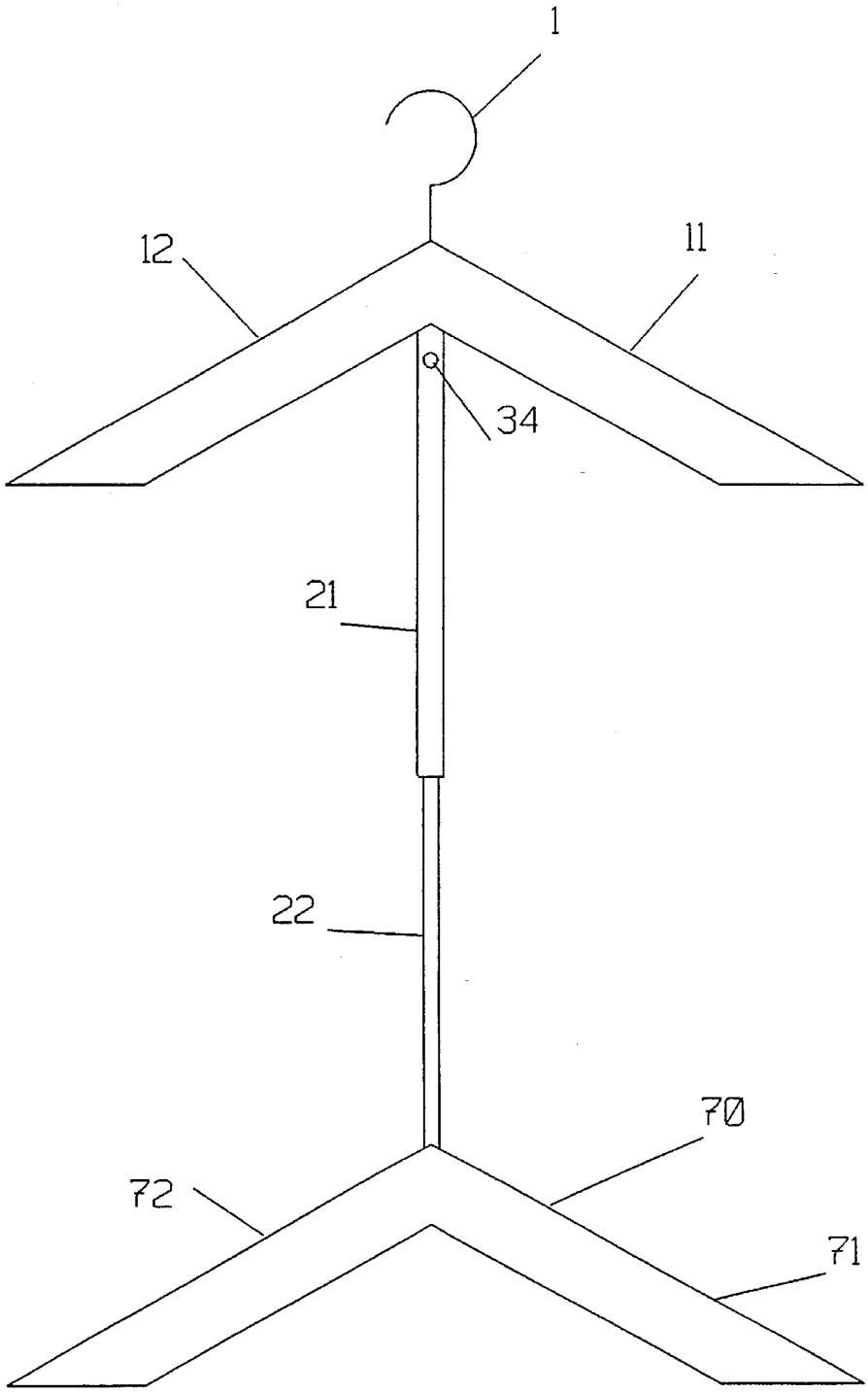
FIG. 7 is an external view of an alternate embodiment of the present invention, showing an alternate lower garment support means.

In an alternative embodiment, as shown in FIG. 7, the lower garment support bar is replaced by a pair of shoulder bars 71 and 72, forming lower garment support means 70. Lower garment support means 70 may alternatively be implemented by an added triangular frame. The invention would then allow for two upper torso garments to be displayed together within the scope of the invention.

In an alternative embodiment, the upper garment support means is formed by a triangular frame instead of two shoulder bars. The upper tube is attached to the cross bar of the triangular frame, directly below the hook.

As an additional feature to any embodiment of the present invention, additional telescoping means may depend from the lower garment support bar. This additional telescoping means can suspend an additional lower garment support bar.

As an additional feature to any embodiment of the present invention accessory support means may be provided on the extension or telescoping means for supporting accessories such as ties, belts, scarves and the like.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

I claim:

1. An improved garment hanger for multiple garments having first garment support means arranged in a plane, with said first garment support means depending directly from retaining means adapted to be suspended on a supporting member, said hanger further comprising a second garment support means adapted to support a second garment, wherein the improvement comprises:

extension means which connects the first garment support means with said second garment support means positioned by the extension means to extend away from the plane of the first garment support means.

2. The garment hanger of claim 1, wherein the extension means comprises:

a fixed member attached to the first garment support means; and a first extendible member, movably connected to the fixed member and attached to the second garment support means.

3. The garment hanger of claim 2, further comprising:

at least one second extendible member, movably connected between the fixed member and first extendible member.

4. The garment hanger of claim 2, further comprising: p1 restraining means which comprises means for supporting the first extendible member in one position relative to the fixed member.

5. The garment hanger of claim 4, wherein the restraining means further comprises:

means for releasing said restraining means.

6. The garment hanger of claim 2, further comprising:

screw threading on the interior of the fixed member; and means for rotatably engaging said screw threading, said means being attached to the exterior of the first extendible member.

7. An improved garment hanger having first garment support means adapted to support a first garment arranged in a plane, with said first garment support means depending directly from retaining means adapted to be suspended on a supporting member, said hanger further comprising a second garment support means adapted to support a second garment, wherein the improvement comprises:

extension means for locating the second garment in a horizontal and vertical direction relative to the plane of the first garment, whereby said extension means comprises means adapted to permit the removal of the second garment from the hanger prior to removing first garment from the hanger, eliminating the need to displace the first garment.

8. The garment hanger of claim 7, wherein the extension means comprises:

an elongated member attached to the first garment support means and directed out of the plane formed by the first garment support means.

9. The garment hanger of claim 7, wherein the extension means comprises:

a fixed member attached to the first garment support means; and a first extendible member, movably connected to the fixed member and attached to the second garment support means.

10. The garment hanger of claim 9, further comprising:

at least one second extendible member, movably connected between the fixed member and the first extendible member.

11. The garment hanger of claim 9, further comprising:

restraining means which comprises means for supporting the first extendible member in one position relative to the fixed member.

12. The garment hanger of claim 11, wherein the restraining means further comprises:

means for releasing said restraining means.

13. The garment hanger of claim 9, further comprising:

screw threading on the interior of the fixed member; and means for rotatably engaging said screw threading, said means being attached to the exterior of the first extendible member.

* * * * *